US005704812A

United States Patent [19]

Moji

[11] Patent Number: 5,704,812

[45] Date of Patent: Jan. 6, 1998

[54] CAR PLUG

[76] Inventor: Eiro Moji, 25-35, Shinmeidai 3-chome, Hamura-shi, Tokyo, Japan

[21] Appl. No.: 712,465

[22] Filed: Sep. 11, 1996

[30] Foreign Application Priority Data

Sep. 11, 1995 [JP] Japan ..... 7-258207

[51] Int. Cl.[6] ..... H01R 13/00

[52] U.S. Cl. ..... 439/668; 439/265

[58] Field of Search ..... 439/668, 265, 439/669

[56] References Cited

U.S. PATENT DOCUMENTS 5,261,838 11/1993 Fujie ..... 439/668

FOREIGN PATENT DOCUMENTS 664384 9/1994 Japan .

*Primary Examiner*—Gary F. Baumen
*Assistant Examiner*—Tho D. Ta
*Attorney, Agent, or Firm*—Browdy and Neimark

[57] ABSTRACT

A car plug used to derive power comprises notches provided at alternate positions among positions obtained by circumferentially dividing a peripheral wall of a body into quarters, terminals of an elastic terminal board incorporated in the body and externally exposed through the notches, notched window-holes formed at alternate remaining positions among the positions obtained by the division into quarters, arm portions having one end connected with the peripheral wall of the body, and the other end for supporting pressure-contact members disposed in the notched window-holes so as to move in a radial direction of the body by the arm portions, the body incorporating a switching cam having cam portions switched over between positions in pressure contact with inner surfaces of arm portions of the elastic terminal board and positions to release the pressure contact, and having cam portions switched over between positions to push out the pressure-contact members to the outer surface side of the body and positions to release the pushing, and operation members for switch-over operation of the switching cam and externally exposed through operation openings in the peripheral wall of the body.

4 Claims, 9 Drawing Sheets

CAR PLUG

BACKGROUND OF THE INVENTION

1. Field of the Invention

This invention relates to an improved car plug used to derive power by utilizing a jack portion for a cigar lighter, mounted in a cabin of an automobile, i.e., by inserting the plug, instead of the cigar lighter, into the jack portion.

2. Description of the Related Art

In a cigar lighter mounted in a cabin of an automobile, an inside diameter of a jack portion varies according to the type of automobile.

A car plug is sold as a car accessory through marketing channels discrete from those of the automobile. Consequently, when the car plug is inserted into a bayonet socket used for the cigar lighter, chattering may be produced between the car plug and an inner periphery of the bayonet socket, or the plug may be excessively tightly fitted. Thus, the car plug requires measures to prevent the above drawbacks.

The measures include one method disclosed in Japanese Utility Model Laid-open No. 6-64384. In the method, as shown in FIGS. 1 and 2, a notched window-hole 3 is provided in a partial peripheral-wall of a body 1 of a car plug A having a cylindrical form. Further, the notched window-hole 3 is mounted on an intermediate position in a circumferential direction between one terminal 20 and another terminal 20 of an elastic terminal board 2 which is incorporated with a core portion of the body 1. An elastic arm 40 is disposed in the window-hole 3 to have one end connected with the peripheral wall of the body 1, and the other end moving inwardly and outwardly with respect to an outer surface of the peripheral wall of the body 1. A projecting body 4 is disposed on an outer surface of the other end of the elastic arm 40, and is provided with a projecting portion 41 radially extending from the outer surface of the peripheral wall of the body 1. Then, as shown in FIG. 5, the body 1 of the car plug A is inserted into a bayonet socket 5 for a cigar lighter, mounted in a cabin of an automobile. In this case, the terminals 20, 20 of the elastic terminal board 2 incorporated with the core portion of the body 1, and the projecting portions 41, 41 of the projecting body 4 are elastically brought into pressure contact with an inner peripheral wall of the bayonet socket 5. Even if the bayonet socket 5 has an inside diameter larger than an outer diameter of the body 1 of the car plug A, the car plug A is applicable to the bayonet socket 5.

In the above method, the terminals 20, 20 of the elastic terminal board 2 are disposed to elastically extend at alternate positions among four positions obtained by dividing the peripheral surface of the body 1 of the car plug A into quarters. Further, the projecting bodies 4 have the projecting portions 41 supported by the elastic arms 40, and are disposed to elastically extend the projecting portions 41 at alternate remaining positions. The terminals 20, 20 and the projecting portions 41 are elastically brought into pressure contact with the inner surface of the bayonet socket 5, thereby accommodating a variation in size of the inside diameter of the bayonet socket. Therefore, when the plug is inserted into one bayonet socket 5 having a somewhat larger inside diameter, the terminals 20, 20 and the projecting bodies 4, 4 may be set to have higher elasticity so as to ensure the pressure contact thereof. In this case, however, when the plug is inserted into another bayonet socket 5 having a somewhat smaller inside diameter, there is a problem in that elastic extension of the terminals 20, 20 and the projecting bodies 4, 4 prevents an inserting operation.

Alternatively, the terminals 20, 20 and the projecting bodies 4, 4 can be set to have lower elasticity for the bayonet socket 5 having a somewhat smaller inside diameter. In this case, however, when the plug is inserted into the bayonet socket 5 having a somewhat larger inside diameter, the terminals 20, 20 and the projecting bodies 4, 4 are brought into insufficient pressure contact with the inner surface of the bayonet socket 5. As a result, there are generated problems such as contact failure, or a drop of the body 1 out of the bayonet socket 5.

SUMMARY OF THE INVENTION

The present invention is made to overcome the problems caused in the prior art. It is an object of the present invention to provide a new measure having the following structure. That is, terminals of an elastic terminal board are disposed at alternate positions among four positions obtained by circumferentially dividing a peripheral surface of a body into quarters, and the terminals can be brought into pressure contact with an inner wall of a bayonet socket with elasticity which selectively becomes higher during insertion into one bayonet socket having a larger diameter, or becomes lower during insertion into another bayonet socket having a smaller diameter. Further, projecting bodies are disposed at alternate remaining positions, and can be switchably fixed at positions to extend from an outer surface of the peripheral wall of the body during the insertion into the bayonet socket having the larger diameter, or be aligned with the outer surface of the peripheral wall of the body or be kept drawn inwardly during the insertion into the bayonet socket having the smaller diameter. In the structure, a car plug can be inserted into and exactly fitted with any type of bayonet socket for a cigar lighter irrespective of a larger inside diameter, frequently used in European automobiles, or a smaller inside diameter, frequently used in Japanese automobiles. Further, the structure enables light insertion into and light removal from the bayonet socket.

According to the present invention, for achieving the above-mentioned objects, there is provided a car plug used to derive power by removably inserting a body having a cylindrical form into a bayonet socket for a cigar lighter, mounted in a cabin of an automobile. The car plug includes notches provided in the body at alternate positions among four positions obtained by circumferentially dividing a peripheral wall of the body into quarters, terminals of an elastic terminal board incorporated in the body, externally exposed through the notches, notched window-holes formed at alternate remaining positions among the four positions obtained by the division into quarters, arm portions having one end connected with the peripheral wall of the body and the other end for supporting pressure-contact members which are disposed in the notched window-holes so as to move in a radial direction of the body by the arm portions, the body incorporating a switching cam having cam portions switched over between positions in pressure contact with inner surfaces of arm portions of the elastic terminal board and positions to release the pressure contact, and having cam portions switched over between positions to push out the pressure-contact members to the outer surface side of the body and positions to release the pushing, and operation members for switch-over of the switching cam, externally exposed through operation openings in the peripheral wall of the body.

In the above structure according to the present invention, an appropriate tool is inserted through the operation opening in the peripheral surface of the body to operate the operation member so as to actuate the switching cam. An intermediate portion of the elastic terminal board urges to extend the terminals incorporated with the peripheral surface of the body. The switching cam enables switch-over of one state in which the intermediate portion of the elastic terminal board is fixed by the cam portion of the switching cam so as to increase spring force to extend the terminal, and another state in which the intermediate portion is released so as to decrease the spring force to extend the terminal. Concurrently, the pressure-contact member can be switched over between an extended state and a state to release the extending pressure. It is thereby possible to provide switch-over between one state to extend and hold the pressure-contact member at the extending position while increasing the spring force to extend the terminal, and another state to release the pressure to extend the pressure-contact member while decreasing the spring force to extend the terminal. As a result, the car plug of the invention is adaptable to both a bayonet socket having a larger inside diameter and a bayonet socket having a smaller inside diameter.

As set forth above, in the car plug according to the present invention, the terminals of the elastic terminal board are disposed at the alternate positions among the four positions obtained by circumferentially dividing the peripheral wall of the body into quarters, and the pressure-contact members are disposed at the alternate remaining positions. In one state, operation of the operation members can actuate the switching cam to increase the spring force to push out the terminals of the elastic terminal board so that the pressure-contact members are pushed out and held at the pushed positions. In another state, the operation of the operation members can actuate the switching cam to decrease the spring force to push out the terminals, of the elastic terminal board so that pushing of the pressure-contact members can be released. Then, the two states can selectively be provided so that the car plug can be used in the following two states through the switch-over operation. In one state, the switching cam is operated to increase spring pressure for pushing out the terminals, and to push out the pressure-contact members so as to extend an outer diameter of the body. As a result, the car plug is adaptable to a bayonet socket having a larger diameter. In another state, the switching cam is operated to decrease spring pressure for pushing out the terminals, and to release the pushing of the pressure-contact members so as to reduce the outer diameter. As a result, the car plug is adaptable to a bayonet socket having a smaller diameter.

The following switch-over operations can concurrently be carried out by operating the operation members through the operation openings. In one switch-over operation, the cam portions of the switching cam selectively increase or decrease the spring force for pushing out the terminals. In another switch-over operation, the cam portions of the switching cam push out the pressure-contact members, or release the pushing. Thus, it is possible to facilitate the switch-over operation of the car plug according to the bayonet socket having the larger diameter or the bayonet socket having the smaller diameter.

Further, the operation members for actuating the switching cam are mounted on the switching cam at the intermediate positions between the cam portions mounted in the first half of the switching cam and the cam portions mounted in the latter half thereof. As a result, it is possible to provide a remarkably simple mechanism to actuate the switching cam, and accurately actuate the cam portions and the cam portions.

Further, the operation openings through which the operation members can be operated are disposed behind the notched window-holes, and are communicated with the notched window-holes in which the pressure-contact members are disposed. As a result, it is possible to enhance workability when the switching cam is supported on the outer periphery of the fuse case to be incorporated in the body.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
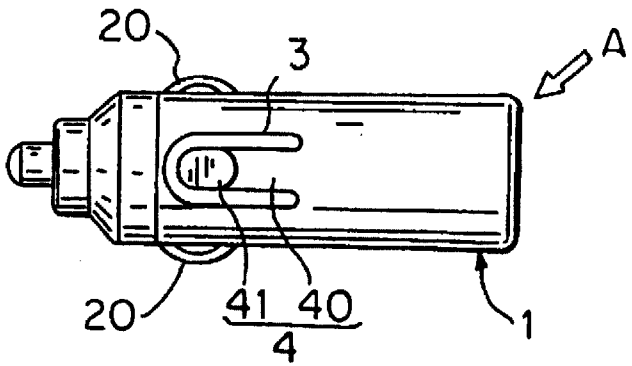
FIG. 1 (PRIOR ART)
FIG. 1 is a plan view of a conventional car plug.
Figure 2:
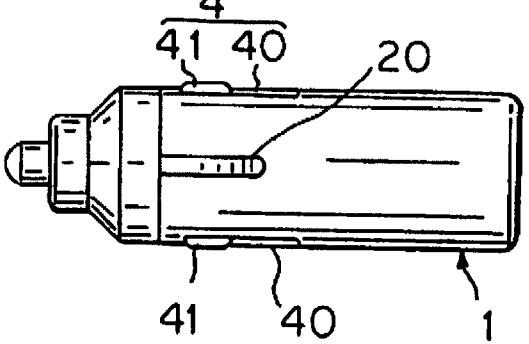
FIG. 2 (PRIOR ART)
FIG. 2 is a side view of the car plug.
Figure 3:
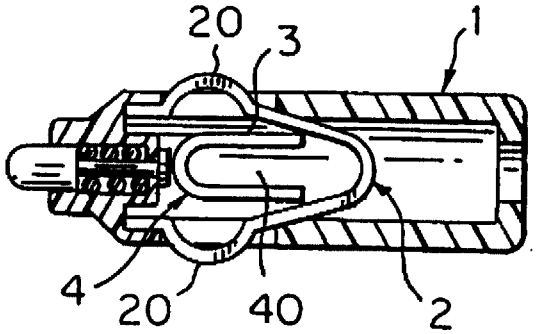
FIG. 3 (PRIOR ART)
FIG. 3 is a cross-sectional plan view of the car plug.
Figure 4:
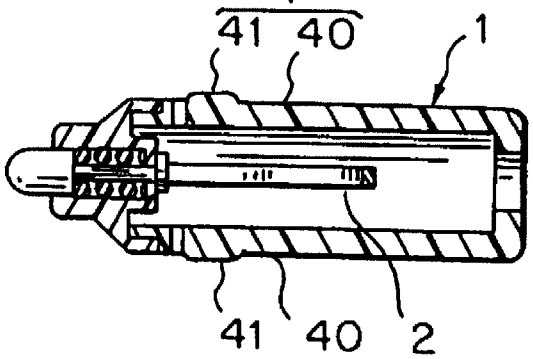
FIG. 4 (PRIOR ART)
FIG. 4 is a longitudinal-sectional side view of the car plug.
Figure 5:
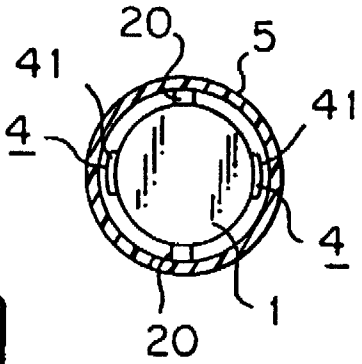
FIG. 5 (PRIOR ART)
FIG. 5 is a longitudinal-sectional front view of the car plug inserted into a bayonet socket.

In the drawings, the same reference numerals are used for structures having effects identical with those of conventional structures.

Figure 6:
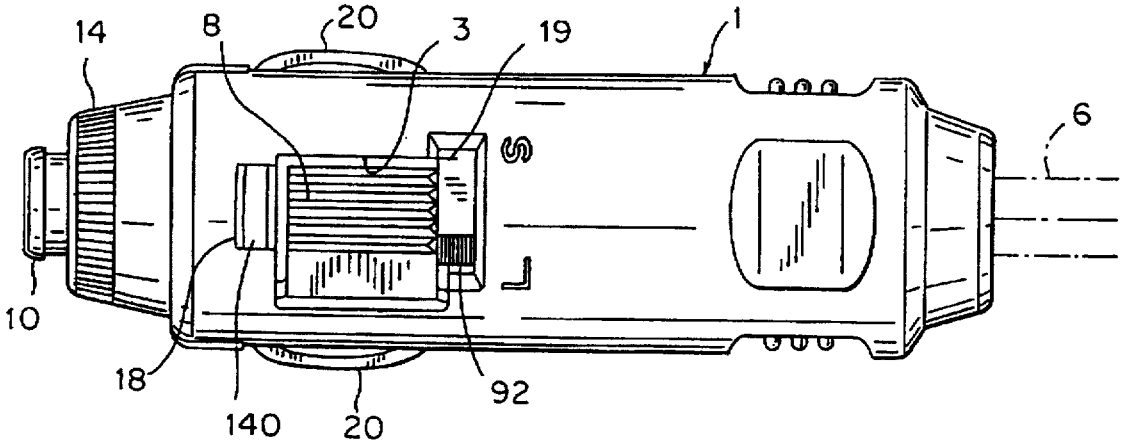
FIG. 6 is a plan view of a car plug according to the present invention.
Figure 7:
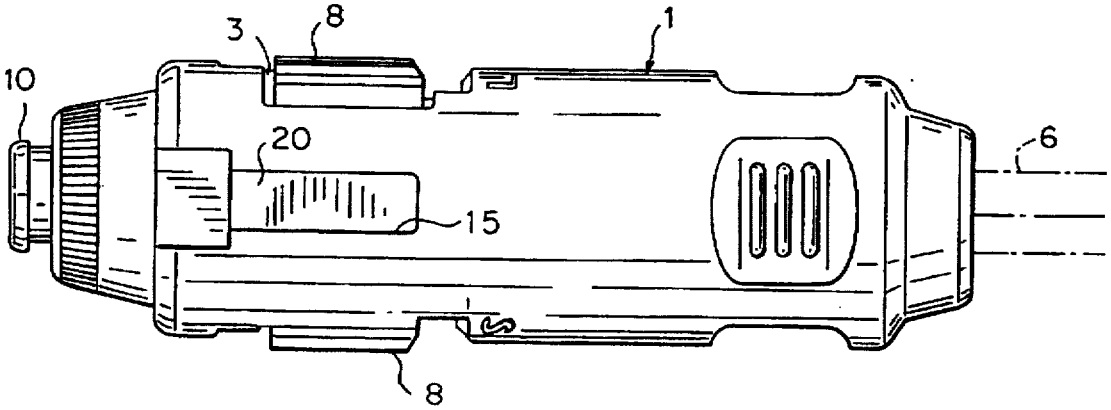
FIG. 7 is a side view of the car plug.
Figure 8:
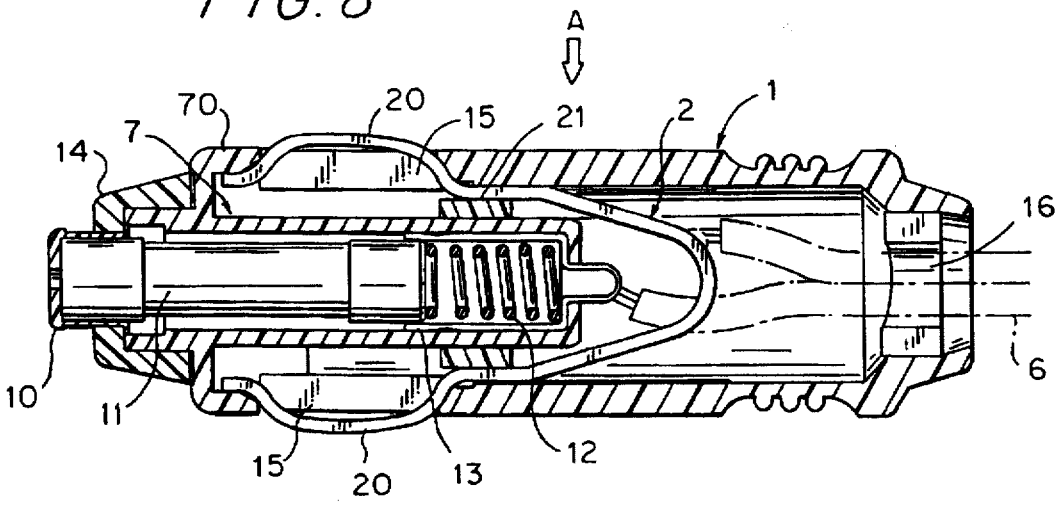
FIG. 8 is a cross-sectional plan view of the car plug.
Figure 9:
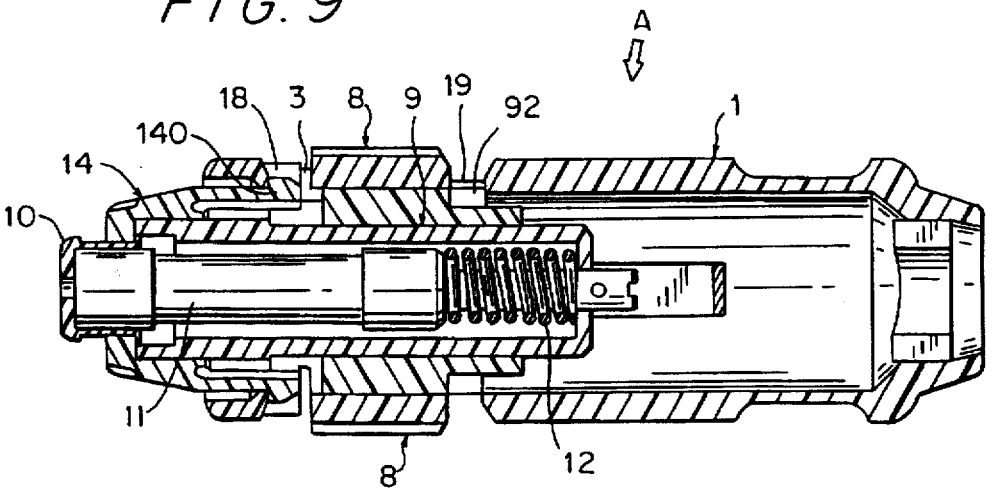
FIG. 9 is a longitudinal-sectional side view of the car plug.

FIG. 6 is a plan view of a car plug A according to the present invention, FIG. 7 is a side view thereof, FIG. 8 is a cross-sectional plan view thereof, and FIG. 9 is a longitudinal-sectional side view thereof. In the drawings, reference numeral 1 means a body having a cylindrical form, 2 is an elastic terminal board incorporated with a core portion of the body 1, 10 is a contact terminal mounted on a top portion of the body 1, 6 is a cord connected to the elastic terminal board 2 and the contact terminal 10, 7 is a fuse case, 11 is a fuse, 12 is a coil spring, 13 is a fuse contact, and 14 is a cap. Further, reference numerals 15, 15 mean notches which are provided in the body 1 to externally expose the terminals 20, 20 of the elastic terminal board 2, 3 are notched window-holes provided in a peripheral wall of the body 1, 8 are pressure-contact members disposed in the notched window-holes 3, and 9 is a switching cam disposed inside the pressure-contact members 8 and incorporated in the body 1.

Figure 10:
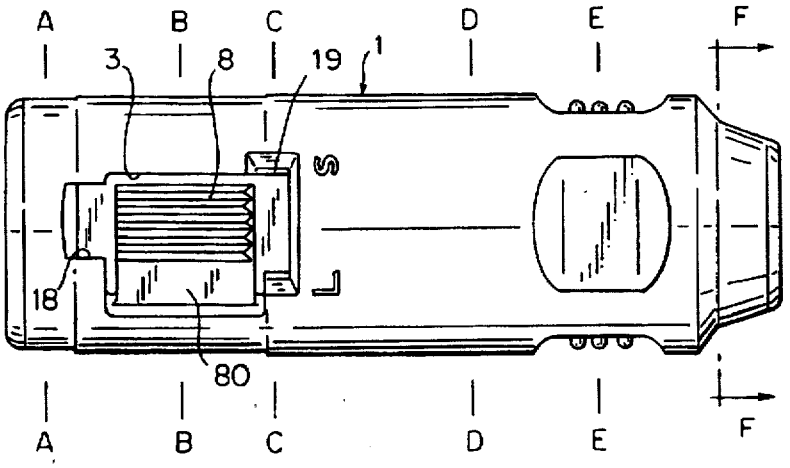
FIG. 10 is a plan view of a body of the car plug.
Figure 11:
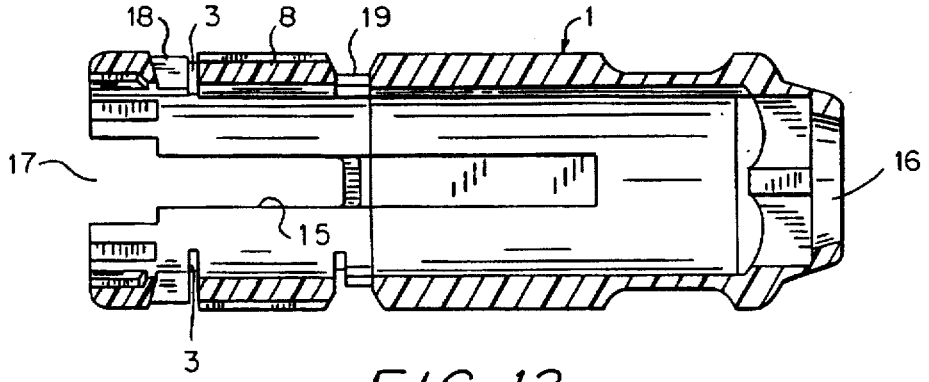
FIG. 11 is a longitudinal-sectional side view of the body of the car plug.
Figure 12:
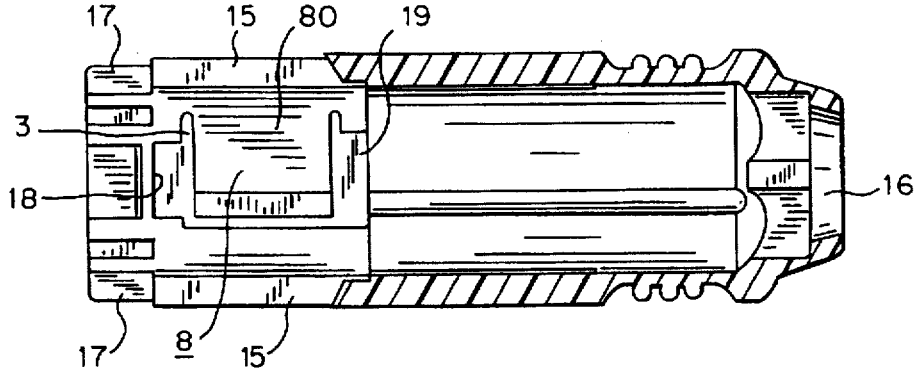
FIG. 12 is a cross-sectional plan view of the body of the car plug.
Figure 13:
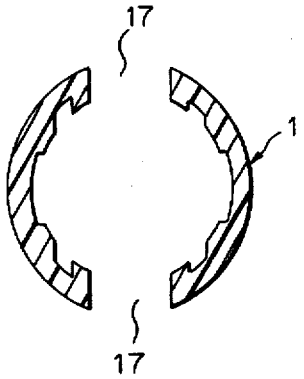
FIG. 13 is a sectional view taken along line A—A of FIG. 10, showing the body of the car plug.
Figure 15:
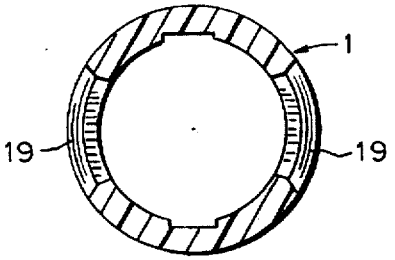
FIG. 15 is a sectional view taken along line C—C of FIG. 10, showing the body of the car plug.
Figure 17:
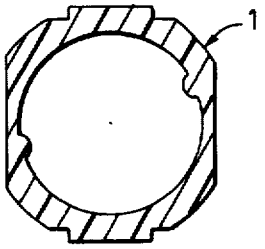
FIG. 17 is a sectional view taken along line E—E of FIG. 10, showing the body of the car plug.
Figure 19:
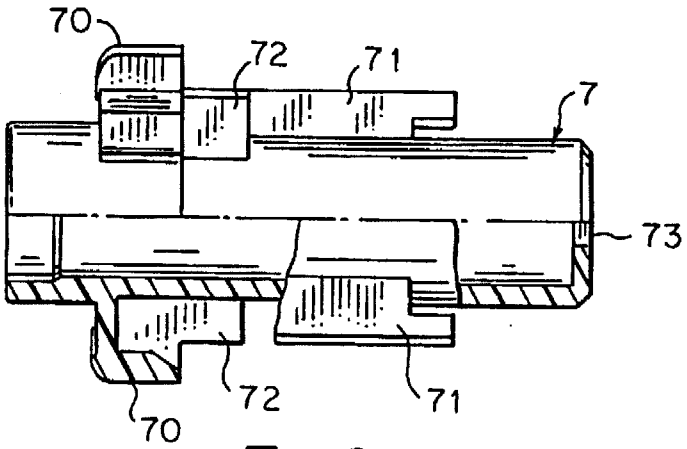
FIG. 19 is a plan view partially broken away of a fuse case of the car plug.
Figure 20:
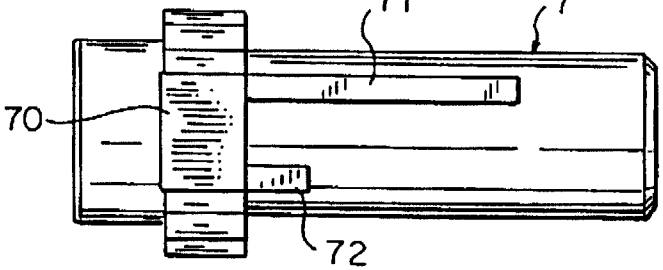
FIG. 20 is a side view of the fuse case of the car plug.
Figure 25:
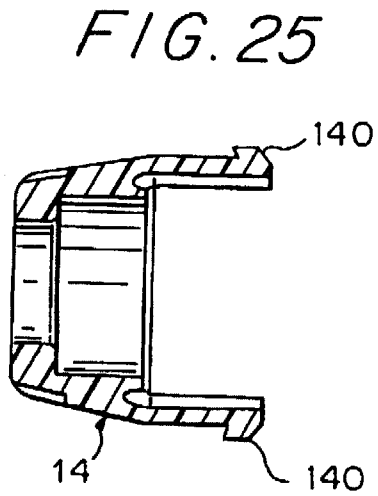
FIG. 25 is a longitudinal-sectional side view of a cap of the car plug.
Figure 26:
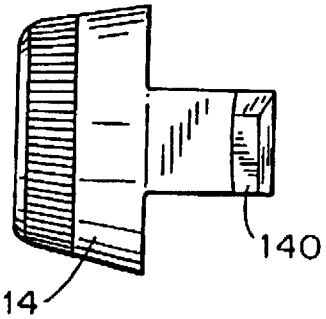
FIG. 26 is a plan view of the cap of the car plug.

The body 1 is made of synthetic resin to have the cylindrical form. As shown in FIGS. 10 to 12, a cord-outlet 16 is provided in a tail end of the body 1, and the top portion of the body 1 is opened. Anchoring grooves 17 are provided in the top portion of the body 1, and are fitted with engaging portions 70 (see FIG. 19) mounted at a front end of the fuse case 7 having a cylindrical form. Further, the anchoring grooves 17 are formed to be communicated with front ends of the notches 15 through which the terminals 20 of the elastic terminal board 2 can move outwardly and inwardly. Additionally, anchoring holes 18 to anchor anchoring claws 140 of the cap 14 are provided in the body 1 at positions obtained by circumferentially shifting the anchoring grooves 17 by 90 degrees.

The notched window-holes 3, in which the pressure-contact members 8 are disposed, are provided in the peripheral wall of the body 1 at positions adjacent to a front end of the body 1, and are formed to be communicated with the back side of the anchoring holes 18 to anchor the anchoring claws 140 of the cap 14. Further, operation openings 19 used to operate the switching cam 9 are formed to be communicated with the back side of the notched window-holes 3.

The pressure-contact member 8 disposed in the notched window-hole 3 is made of the same synthetic resin as that of the body 1, and is provided in the flat form having a size which is substantially sufficient to cover the notched window-hole 3. An arm portion 80 is provided at one end of the pressure-contact member 8 in a circumferential direction of the body 1, and the pressure-contact member 8 is connected through the arm portion 80 with an opening edge of the notched window-hole 3. Further, the pressure-contact member 8 is supported by the body 1 so as to move inwardly and outwardly in a radial direction with respect to the peripheral wall of the body 1 through a bend of the arm portion 80.

In the pressure-contact member 8 in the illustrated embodiment, one end of the arm portion 80 extending in the circumferential direction of the body 1 is connected with and supported by the peripheral wall of the body 1. Thus, the arm portion 80 can be bent in a radial direction of the body 1 with the connected portion as a supporting point. Alternatively, one end of the arm portion 80 extending in an axial direction of the body 1 may be connected with and supported by the peripheral wall of the body 1. Consequently, the arm portion 80 may be bent in the radial direction of the body 1 while being moved in the axial direction of the body 1.

However, as in the illustrated embodiment, the arm portion 80 is preferably set to be bent in the radial direction of the body 1 while being moved in the circumferential direction of the body 1. By using the fuse case 7 incorporated in the body 1 as a fulcrum shaft, the switching cam 9 is rotated about a rotation axis extending along a longitudinal axis of the body 1. In this case, the arm portion 80 can thoroughly agree with switch-over operations of cam portions 90 and 91 of the switching cam 9.

As shown in FIGS. 19 to 22, the fuse case 7 is made of synthetic resin to have a hollow cylindrical form. The engaging portions 70 are mounted on an outer periphery of the front end of the fuse case 7 to extend like a pair of horns, and are fitted into the anchoring grooves 17 formed in the front end of the body 1 when the fuse case 7 is fitted as an inner cylinder into the body 1 from the front end thereof. Longer protrusions 71, 71 axially extend from an outer peripheral surface of the fuse case 7 at two positions obtained by bisection of the outer peripheral surface in a circumferential direction, and serve as guides when the fuse case 7 is fitted into the body 1. Shorter protrusions 72, 72 axially extend at positions adjacent to the longer protrusions 71, 71. Further, a back end surface of the fuse case 7 is provided with a rectangular window-hole 73 through which a terminal 130 of the fuse contact 13 extends.

Figure 22:
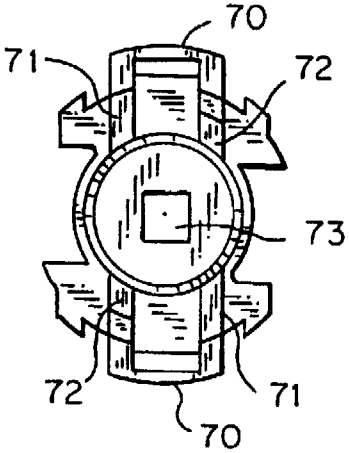
FIG. 22 is a back view of the fuse case of the car plug.
Figure 23:
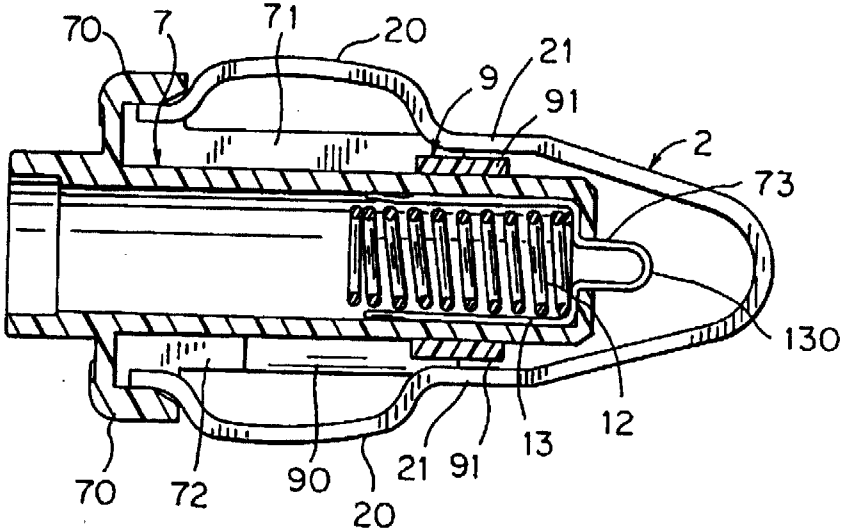
FIG. 23 is a cross-sectional plan view of the fuse case of the car plug with a switching cam and an elastic terminal board incorporated.

As shown in FIGS. 22 and 23, the fuse contact 13 and the coil spring 12 are loaded into a bore in the fuse case 7, and the switching cam 9 and the elastic terminal board 2 are incorporated with the outer periphery of the fuse case 7. In this state, the fuse case 7 is fitted into the body 1 to fit the engaging portions 70 into the anchoring grooves 17 in the body 1, thereafter inserting the fuse 11. Subsequently, the contact terminal 10 is fitted with an external end of the fuse 11. The cap 14 is made of synthetic resin to have a form as shown in FIGS. 25 to 28, and the body 1 is covered with the cap 14 from the front side thereof. The anchoring claws 140 of the cap 14 are anchored by the anchoring holes 18 in the body 1, thereby incorporating the cap 14 with the body 1.

The switching cam 9 is operated such that the pressure-contact members 8 can extend from an outer surface of the peripheral wall of the body 1. The switching cam 9 is provided in a ring form as shown in FIGS. 29 to 32. As stated above, the fuse case 7 is incorporated as the inner cylinder into the core portion of the body 1. The switching cam 9 is rotatably supported on the outer periphery of the fuse case 7 with the fuse case 7 as the fulcrum shaft.

Figure 24:
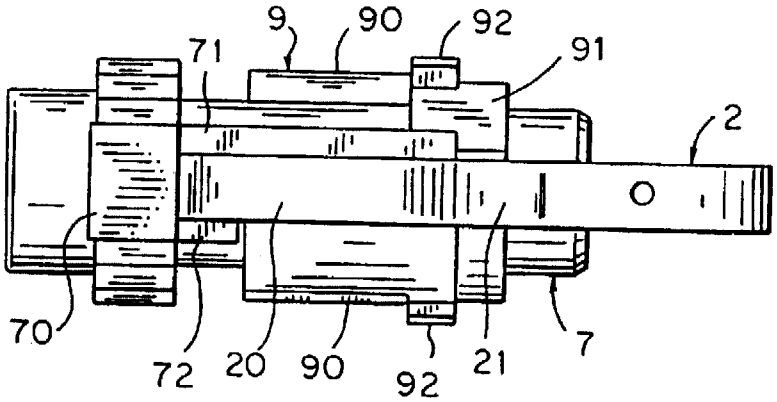
FIG. 24 is a side view of the fuse case of the car plug with the switching cam and the elastic terminal board incorporated.
Figure 27:
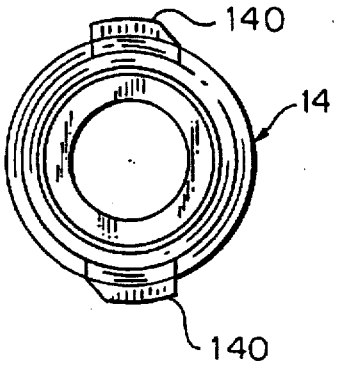
FIG. 27 is a back view of the cap of the car plug.
Figure 28:
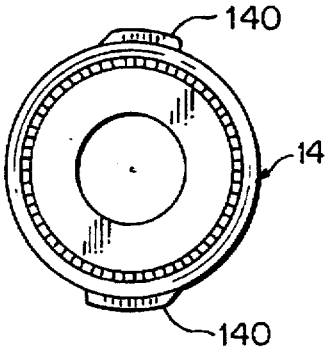
FIG. 28 is a front view of the cap of the car plug.
Figure 29:
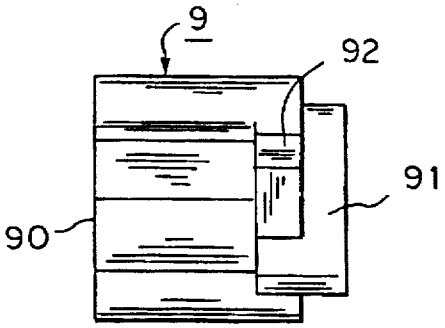
FIG. 29 is a plan view of the switching cam of the car plug.
Figure 30:
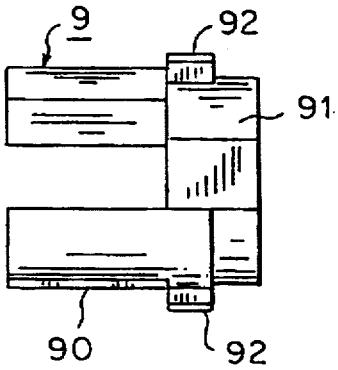
FIG. 30 is a side view of the switching cam of the car plug.
Figure 33:
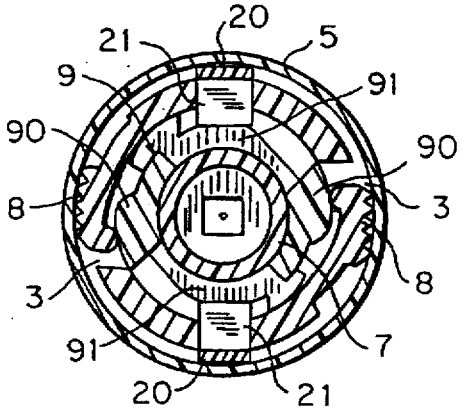
FIG. 33 is a longitudinal-sectional front view of the car plug with the switching cam rotated on the side to extend a diameter.
Figure 34:
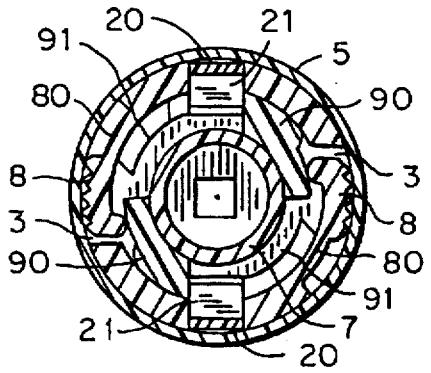
FIG. 34 is a longitudinal-sectional front view of the car plug with the switching cam rotated on the side to reduce a diameter.
Figure 35:
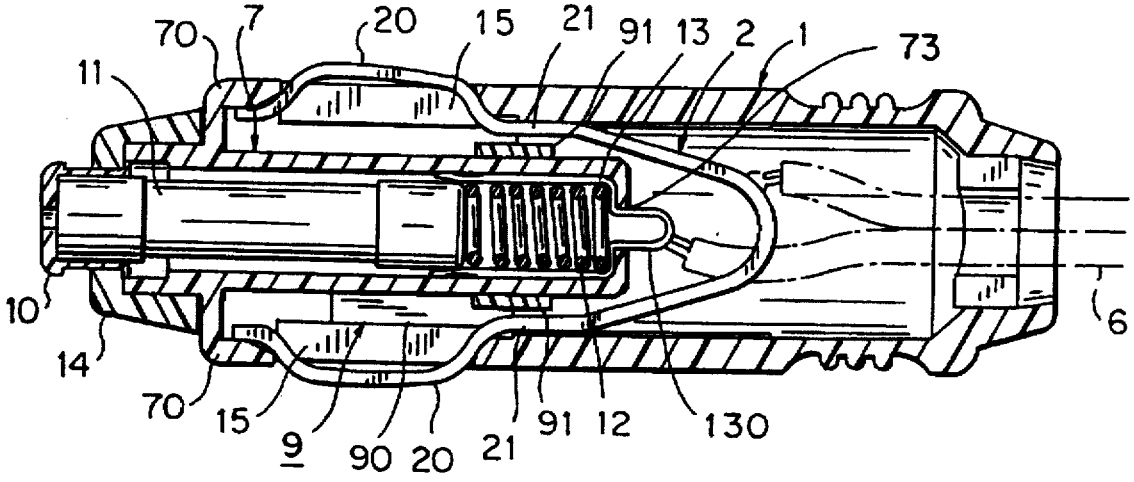
FIG. 35 is a cross-sectional plan view of the car plug with the switching cam rotated to a position to reduce the diameter.
Figure 36:
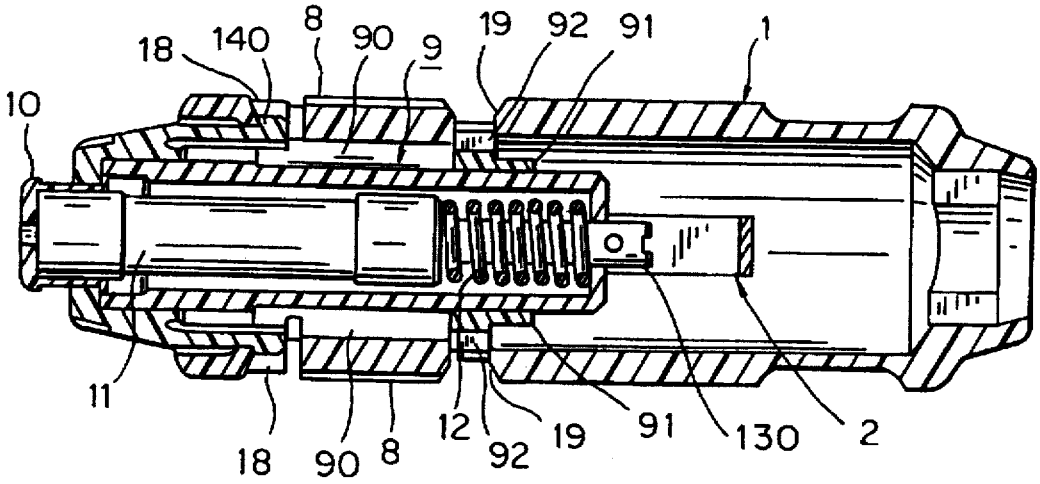
FIG. 36 is a longitudinal-sectional side view of the car plug with the switching cam rotated to the position to reduce the diameter.

The switching cam 9 is supported on the outer periphery of the fuse case 7 as shown in FIGS. 23 and 24. On the front end side of the switching cam 9 (i.e., on the left end in the drawings), there are provided cam portions 90 having two higher and lower steps in a circumferential direction, for switch-over control of one state in which the cam portions 90 push out and extend the pressure-contact members 8 to the outside of the peripheral wall of the body 1 (FIG. 33), and another state in which the pressure-contact members 8 are kept released (FIG. 34). Further, on the back end side of the switching cam 9, there are provided cam portions 91 having two higher and lower steps in a circumferential direction, for switch-over control of one state in which the cam portions 91 are brought into pressure contact with inside positions of arm portions 21 of the elastic terminal board 2 to increase spring forces of the arm portions 21 (FIG. 8), and another state in which the cam portions 91 move apart from inner surfaces of the arm portions 21 to decrease the spring forces of the arm portions 21 (FIG. 35).

Further, operation members 92 for rotating the switching cam 9 are mounted at intermediate positions in a longitudinal direction between the cam portions 90 and the cam portions 91. The operation members 92 can face the operation openings 19 which are provided in the peripheral wall of the body 1. Thus, the operation members 92 can be moved in the circumferential direction of the body 1 by inserting a tool such as screwdriver, or pin through the operation openings 19. It is thereby possible to complete the switch-over operation of the switching cam 9.

The operation openings 19 are provided in the peripheral wall of the body 1 such that the operation members 92 of the switching cam 9 can be operated therethrough from the outer surface side of the body 1. In the illustrated embodiment, the notched window-holes 3 are provided in the peripheral wall of the body 1 such that the pressure-contact members 8 can be disposed therein, and the operation openings 19 are positioned behind the notched window-holes 3 to be communicated therewith. However, apart from the notched window-holes 3, the operation openings 19 may independently be provided as window-holes.

Figure 31:
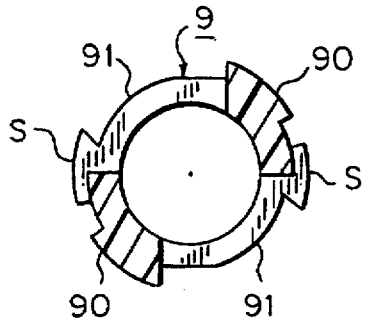
FIG. 31 is a front view showing an essential part of the switching cam of the car plug.

In the switching cam 9, the cam portion 90 for control of the pressure-contact member 8 and the cam portion 91 for control of the elastic terminal board 2 are formed as shown in FIG. 31, that is, formed to establish a substantially perpendicular deviation in the circumferential direction. Therefore, rotation of the switching cam 9 can concurrently control the pressure-contact members 8, 8 and the terminals 20, 20 of the elastic terminal board 2 which are disposed at four positions obtained by circumferentially dividing the peripheral surface of the core portion of the body 1 into quarters.

Figure 32:
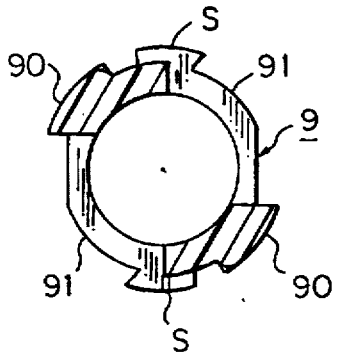
FIG. 32 is a front view showing the essential part of the switching cam of the car plug during switch-over rotation.

If the switching cam 9 is rotated from a state shown in FIG. 31 to a state shown in FIG. 32, stopper portions S collide with the protrusions 71 extending from the peripheral surface of the fuse case 7. Consequently, rotation of the operation members 92 of the switching cam 9 can be restricted in an angular range limited by the collision, and the operation member 92 is reciprocated and rotated within the angular range.

Figure 14:
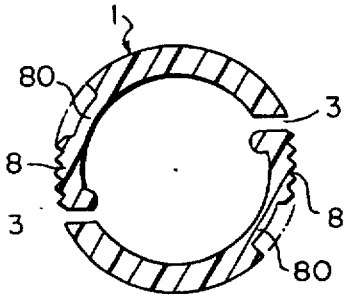
FIG. 14 is a sectional view taken along line B—B of FIG. 10, showing the body of the car plug.
Figure 16:
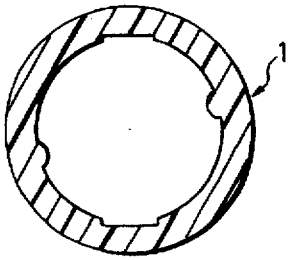
FIG. 16 is a sectional view taken along line D—D of FIG. 10, showing the body of the car plug.
Figure 18:
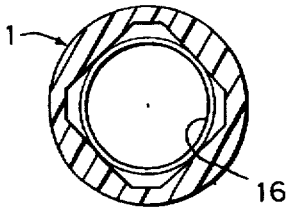
FIG. 18 is a sectional view taken along line F—F of FIG. 10, showing the body of the car plug.
Figure 21:
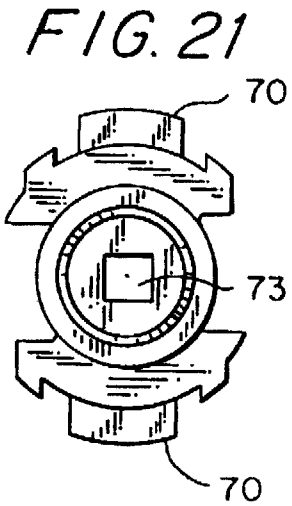
FIG. 21 is a front view of the fuse case of the car plug.

Further, as shown in FIG. 14, the pressure-contact members 8 controlled by the cam portions 90 of the switching cam 9 are mounted on the body 1 such that outer surfaces of the pressure-contact members 8 are aligned with the outer peripheral surface of the peripheral wall of the body 1, or are positioned on the inside of the outer peripheral surface. As shown in FIG. 33, the cam portions 90 are rotated and positioned on the side of lower surfaces of the pressure-contact members 8. Subsequently, the pressure-contact members 8 are pushed out by the cam portions 90, and are pushed outwardly from the outer peripheral surface of the peripheral wall of the body 1.

What is claimed is:

1. A car plug used to derive power by removably inserting a body having a cylindrical form into a bayonet socket for a cigar lighter, mounted in a cabin of an automobile, the car plug comprising:

notches provided in the body at alternate positions among four positions obtained by circumferentially dividing a peripheral wall of the body into quarters;

terminals of an elastic terminal board incorporated in the body and externally exposed through the notches;

notched window-holes formed at alternate remaining positions among the four positions obtained by the division into quarters;

arm portions having one end connected with the peripheral wall of the body, and the other end for supporting pressure-contact members which are disposed in the notched window-holes so as to move in a radial direction of the body by the arm portions;

the body incorporating a switching cam having cam portions switched over between positions in pressure contact with inner surfaces of arm portions of the elastic terminal board and positions to release the pressure contact, and cam portions switched over between positions to push out the pressure-contact members to the outer surface side of the body and positions to release the pushing; and operation members for switch-over operation of the switching cam and externally exposed through operation openings in the peripheral wall of the body.

2. A car plug according to claim 1, wherein the operation openings through which the operation members of the switching cam can be operated are formed behind the notched window-holes and are communicated with the notched window-holes in which the pressure-contact members are disposed.

3. A car plug according to claim 1, wherein the switching cam is provided in a ring form, and is rotatably supported on an outer periphery of a fuse case incorporated as an inner cylinder in the body, the cam portions being disposed in a first half of the switching cam to be switched over between a state to push out the pressure-contact members and a state to release the pushing, and the cam portions being disposed in the latter half to be switched over between a state in pressure contact with the inner surfaces of the arm portions of the elastic terminal board and a state to release the pressure contact.

4. A car plug according to claim 2, wherein the operation members are mounted on the switching cam at intermediate positions between the cam portions in the first half and the cam portions in the latter half.

* * * * *